United States Patent [19]

Backus

[11] Patent Number: 4,598,567

[45] Date of Patent: Jul. 8, 1986

[54] APPARATUS FOR CONTINUOUS EXTRUSION OF METALS

[76] Inventor: Henricus P. Backus, Past. Debetstraat 2,, 6245 CN Eysden, Netherlands

[21] Appl. No.: 617,505

[22] Filed: Jun. 5, 1984

[30] Foreign Application Priority Data

Jun. 6, 1983 [NL] Netherlands ..... 8302003

[51] Int. Cl.[4] ..... B21C 25/04; B21C 33/00

[52] U.S. Cl. ..... 72/262; 72/269; 72/467

[58] Field of Search ..... 72/262, 269, 467

[56] References Cited

U.S. PATENT DOCUMENTS

| | | | |
|---|---|---|---|
| 3,824,825 | 7/1974 | Green | 72/262 |
| 4,163,377 | 8/1979 | Moreau | 72/262 |
| 4,242,368 | 12/1980 | Nagai et al. | 72/262 |
| 4,277,968 | 7/1981 | Pardoe | 72/262 |

FOREIGN PATENT DOCUMENTS

| | | | |
|---|---|---|---|
| 88926 | 7/1980 | Japan | 72/262 |
| 128316 | 10/1980 | Japan | 72/262 |
| 139222 | 10/1981 | Japan | 72/262 |
| 57-159213 | 10/1982 | Japan | 72/262 |
| 58-23511 | 2/1983 | Japan | 72/262 |
| 47510 | 3/1983 | Japan | 72/262 |
| 45020 | 3/1984 | Japan | 72/262 |
| 7302484 | 10/1973 | Netherlands | 72/269 |
| 7603342 | 3/1976 | Netherlands | 72/262 |
| WO83/00452 | 2/1983 | PCT Intl. Appl. | 72/262 |
| 2078584 | 1/1982 | United Kingdom | 72/262 |

*Primary Examiner*—Lowell A. Larson

*Attorney, Agent, or Firm*—Wegner & Bretschneider

[57] ABSTRACT

An apparatus for continuously extruding metals by moving a channel wall in a wheel to frictionally urge the metal to an extrusion opening and then to a shaping die. An extrusion passage with substantially parallel walls having a length at least equal to the transverse dimensions of the passage is provided between the extrusion opening in the channel and a wider space. The extrusion passage merges without sudden change of the transverse dimensions gradually into the wider space having a central flow axis for the metal substantially in line with the central flow axis of the passage.

5 Claims, 3 Drawing Figures

APPARATUS FOR CONTINUOUS EXTRUSION OF METALS

Figure 1:
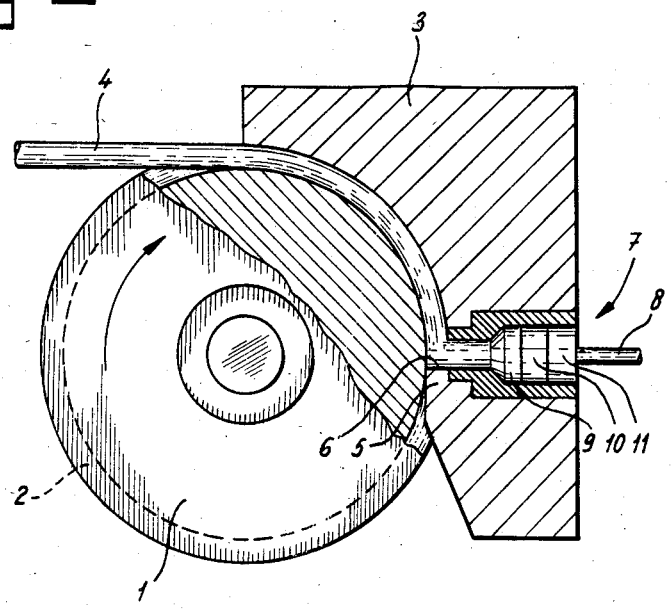

This invention relates to an apparatus for continuous extrusion of metals in which the surface parts of the metal to be extruded do not substantially form surface parts of the extruded metal product, with a channel with substantially parallel walls, one wall being continuously movable with respect to another wall of the channel to feed the metal supplied to the channel along it by friction under generation of heat, said channel being substantially closed at the end opposite the feed end with the exception of an extrusion opening giving access for the metal to a wider space in an extrusion chamber adjoining and supplying the metal to a through-flow shaping die.

The channel is usually curved and the moving wall is usually the surface of a groove in a rotating wheel.

Such an apparatus is known from Technical Paper MF 76-407 of the Society of Manufacturing Engineers, Dearborn, Mich., 1976, article by E. Hunter: Continuous Extrusion by the Conform Process, pp. 1–20, and moreover from U.S. Pat. No. 4,277,968 to Pardoe and U.S. Pat. No. 4,242,368. In said publication of Hunter, FIG. 12, the metal flows from the channel directly into a widening expansion space, which directly adjoins the shaping die of smaller cross-sectional area of the exit opening determining the shape of the extruded profile.

In U.S. Pat. No. 4,277,968 there are, in FIGS. 1–4, two channels side by side in the same wheel the wider space taking up and combining the metal from both channels.

This gives a rather sudden change of flow section and a rather sharp bend in the metal between an extrusion passage with parallel walls immediately joining the extrusion opening in the channel and this wider space. In FIG. 5 thereof there is only one such channel, but again the transition between extrusion passage and wider space is very sudden.

In U.S. Pat. No. 4,242,368 there is a very short extrusion passage from the channel to the wider space.

It has appeared that, particularly in cases in which very high requirements have to be made to the quality of the profiles to be extruded and their surface characteristics, such as to smoothness and uniformity, such known apparatus does not always give the best possible results in such respects, particularly not if the profiles to be extruded have more complicated shapes than simple rods or wires with circular cross-sections. The profiles obtained often show such deficiencies in quality and even minor surface cracks.

This is probably due to sudden changes of flow speed and direction of the metal between the extrusion opening of the channel and the shaping die. For certain purposes such as cladding of wires as indicated in U.S. Pat. No. 4,242,368 and in part of the embodiments of U.S. Pat. No. 4,277,968 such deficiencies often are not of much harm, but in other cases they are.

Friction of the moving wall with the metal to be extruded and of the metal moving along stationary walls of the apparatus generates heat which should bring the metal in the desired condition of plastic deformability.

The metal passing the extrusion opening in the channel shows differences in speed, temperature and pressure in different points of the cross-section of said opening.

The invention is first of all based on the idea that the quality of the extruded products may be improved and the problems indicated above as to the deficiencies of the known apparatus may be solved if according to the invention an apparatus as given in the preamble above is characterized in that between the extrusion opening in the channel and said wider space there is an extrusion passage with substantially parallel walls of a length at least equal to its transverse dimensions and merging without sudden change of said transverse dimensions gradually into said wider space, which has a central flow axis for the metal substantially in line with the central flow axis of said passage.

The said extrusion passage will thus equalize temperatures, speeds and pressures in the metal flowing through to such an extent that a better quality particularly of thin-walled tubes and profiles of more intricate shape extruded through the shaping die can be obtained, both in quality inside such extruded bodies and in quality of the surface thereof.

It is often preferred to direct the axis of the extrusion passage and of the wider space at an angle of about 90° with respect to the channel with the moving wall. If such an angle would be made smaller (it is even known to make it 0°), this does not as such avoid the abovementioned problems and is often preferred for other reasons.

It is not fully clear yet how such effects can be explained. The metal will, in part of its path, under the prevailing pressures and temperatures behave more or less as a viscous liquid, so that influences of "turbulences" in the metal flow are probable. It might normally be expected that the harmful effects of sudden changes in direction and of sudden transitions from wider to more narrow passage spaces between channel and extrusion opening would only be overcome further downstream by a suitable shape of the wider space and of the shaping die.

According to the invention it is possible, contrary to what might be expected, to apply a simple measure as given above as to the extrusion passage to obtain very good results in the extruded metal. This moreover allows one to extrude e.g. thin walled tubes with a wall thickness of 0.4 mm of the highest quality. The surface thereof may even have a roughness below 5$\mu$, being so smooth that hardly any oxidation problems, usually due to a rough surface e.g. for copper, are left. This opens a new possibility for making e.g. tube radiators for motor vehicles from such thin-walled tubes of copper or of aluminium in the alloy group 3.000 of the International Standards (with a.o. some manganese). Up to now it was only possible to build up such tube radiators from tubes obtained from thicker-walled tubes, made by some swaging or extrusion method, and by cold-drawing them in 4 to 6 stages to the desired thin wall thickness, with one or two heat treatments between and if desired also after such cold drawing stages.

Preferably, in applying the invention, the terminal wall for closing the channel with the moving wall merges fluently into a wall part of said extrusion passage directed with its axis substantially perpendicularly to said flow direction in the channel to obtain an even better result as to the quality of the extruded products and the energy required in making them.

To obtain said objects more fully, it is often preferred that the flow axis in the shaping die is substantially in line with the axes of the extrusion passage and of said wider space, and if the shaping die has, in known manner, more than one flow passage for the metal, that said passages have outer walls substantially in line with part of the outer wall of said wider space.

The best and simple practical shape of the transition zone between the extrusion passage and the wider space is formed by a substantially conical or pyramidal wall part having a total cone angle from 75° to 105°.

Figure 3:
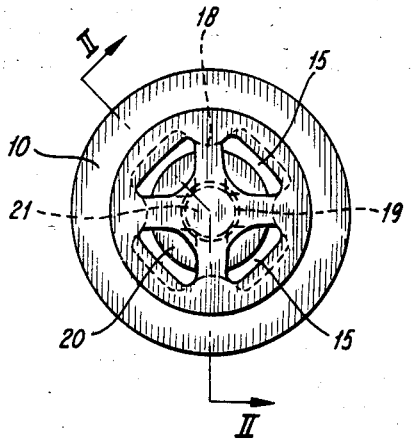
Figure 2:
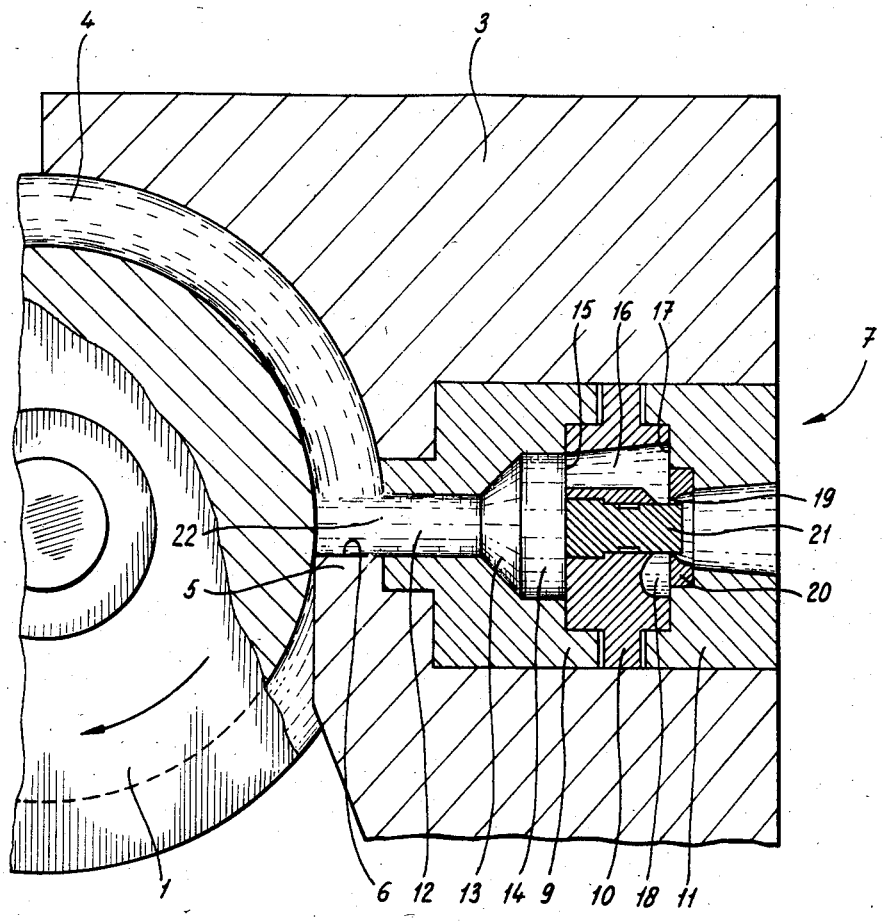

The invention will now be explained in more detail with reference to the enclosed drawings. Therein:

FIG. 1 gives a somewhat diagrammatic section perpendicularly to the axis of the rotating extrusion wheel and partly a view in the direction of said axis, of an extrusion apparatus according to the invention;

FIG. 2 gives, at a larger scale, part of this apparatus in some more detail and in a section along the plane indicated by II—II in FIG. 3; and FIG. 3 is a view of the shaping die as seen from the right in FIGS. 1 and 2.

A rotating wheel 1 has a peripheral groove 2 and cooperates with a shoe 3, which in known manner is urged slidingly or pivotally towards the wheel, which shoe closes the groove substantially at 5, 6. Material to be extruded is indicated by 4 and is e.g. a round wire or long rod of copper, aluminium or an alloy thereof and this is supplied to the groove 2 as shown in FIG. 1 so as to enter the groove near one end of the shoe. The shoe has a part 5 engaging the groove 2 and substantially closing it, which part 5 forms an abutment surface 6, which causes the metal to flow sideways through an extrusion opening 22 towards a die structure 7, given in more detail in FIGS. 2 and 3. An extruded body such as 8 in FIG. 1, which in the case of a shaping die as shown in FIG. 2 will be a thin-walled tube, leaves this apparatus during the extrusion.

In operation the wheel 1 is rotated in the direction of the arrow and thus the walls of the groove 2 will entrain said material under slipping friction, so that there is considerable heat generation bringing the material in a more plastic condition to facilitate extrusion and allowing it to flow away by the influence of abutment surface 6 sideways to the die structure 7. It is thus possible to extrude a body 8, of which the surface does not or only to a slight extent consist of parts which had formed the surface of the blank material 4 fed to the apparatus.

The die structure 7 comprises three inserts 9, 10 and 11 positioned in the shoe 3 and shown in FIG. 1 as forming one part, but shown as separate parts in FIG. 2. These inserts are secured in the shoe and with respect to each other by bolts or screws not shown and in a usual manner.

The insert 9 immediately borders the channel formed by the groove 2 in wheel 1 in the area of the abutment surface 6 and forms an expansion nozzle. It has a first cylindrical passage 12 (cylindrical in the mathematical sense of having straight parallel generating lines and having a cross-section which may be circular but may instead be oval, square or somewhat rectangular). The abutment surface 6 may have a shape adapted thereto, so that it may be flat but also curved if desired. This passage 12 forms an extrusion passage of a length at least about equal to its transverse dimension or largest transverse dimension.

By a rather sharp but not stepped transition said passage 12 merges into a widening part 13 which preferably is about conical or pyramidal and which has preferably a total cone angle of between 75° and 105°. This merges into a part 14 forming a wider space and also being cylindrical in the above sense and this space may if desired be considerably shorter than extrusion passage 12.

The wider space 14 gives access for the metal to the shaping die 10, which according to FIG. 3 may have four inlet openings 15, each giving access to a channel 16 of gradually widening shape from left to right and terminating in a terminal surface 17 of body 11. In the proximity of this terminal surface said passages 16 are mutually connected by open spaces 18, so that the metal flowing through the four passages 16 is again connected to a single body which is extruded through an annular slot 19 between a very hard die part 20, embedded in body 11, and a hard mandrel 21, carried by body 10, so that in this case by said mandrel a tubular body is extruded. This is known as such. If another shape of the extruded profile is desired, this shaping die should be replaced by a shaping die of other form, shape and dimensions, which means replacing die part 20 (the die insert) and if desired omitting the mandrel 21. It would also be possible to lead the metal of each one of the passages 16 immediately to such a terminal extrusion opening in the die to form in this case four separate extruded profiles, or they may be connected by connections such as 18 to form e.g. two separate extruded bodies.

The hard die insert 20 and the mandrel 21 are preferably made from hardmetal or a cermet or similar hard ceramic material with a hardness of about $H_{RC}$ 85, anyhow higher than $H_{RC}$ 80, and so that they have a very smooth surface of the opening in insert 20 and along the cylindrical outer surface of the part of the mandrel 21 protruding therein. The radial dimension of the annular slot 19 may have any desired value, but may be as small as even 0.4 mm for the direct extrusion of very thin walled tube. Those parts 20 and 21 may be secured by shrinking in their surrounding parts 11 and 10 of the die.

If desired, heating means may be arranged around the opening 12 if, as may be the case in certain copper alloys, a somewhat higher deformation temperature is necessary than obtained by friction and deformation alone.

It will be clear from those drawings that the abutment surface 6 merges immediately into part of the wall of the extrusion passage 12, that in the parts 12, 13 and 14 there is no sudden change of diameter, that the passage 12 is longer than its transverse dimension and that the outer wall parts of the passages 16 in the die merge fluently with the outer wall of the wider space 14. The axis of passage 12 is in line with the axis of wider space 14 and thus transition part 13 widens to all sides, contrary to what is the case in several known structures, and this appears to be of advantage for the good quality of the extruded product. It is also preferable, but not always necessary, that the flow axis of the shaping die structure in parts 10 and 11, as seen as the central line of the flow of the metal, is also in line with the axes of the parts 12, 13 and 14.

I claim:

1. An apparatus for the continuous extrusion of metal wherein the surface parts of the metal to be extruded do not substantially form surface parts of the extruded metal product, comprising:

a channel having a feed end for accepting metal to be extruded, defined by a first movable member having a continuous groove and a second stationary member partially overlying the length of said groove, one wall of said channel being continuously movable with respect to another wall of said channel to feed metal supplied to said channel along said channel by friction with the generation of heat sufficient to convert said metal to a viscous fluid state, said channel being substantially closed at the end opposite the feed end, said channel including an extrusion opening in the stationary member;

a space wider than said extrusion opening in fluid communication with said extrusion opening;

a through-flow shaping die adjoined to said space, metal passing from said space to said through-flow die, and an extrusion passage having a central flow axis providing fluid communication between said extrusion opening and said space, having a first and second portion, said first portion of said extrusion passage having first and second ends and substantially parallel walls of a length at least equal to the transverse dimension of said extrusion passage, said second portion of said extrusion passage having first and second ends and a wall which gradually flares outwardly in a direction from said first end of said second portion of the extrusion passage to said second end of said second portion of the extrusion passage;

said first end of said first portion cooperating with said extrusion opening, said second end of said first portion cooperating with said first end of said second portion and said second end of said second portion cooperating with said space so that said extrusion passage provides fluid communication between said extrusion opening and said space so that the metal in a viscous fluid state flows sequentially through said extrusion opening along said first portion of said extrusion passage, and along said second portion into said space;

said space having a central flow axis for said metal substantially in line with the central flow axis of said extrusion passage.

2. An apparatus according to claim 1, further comprising a terminal wall for closing the channel near the extrusion opening positioned substantially perpendicular to the flow direction of the metal in the adjacent part of the channel and merging directly into a wall part of said extrusion passage, said extrusion passage being directed with its axis substantially perpendicular to said channel at said terminal wall.

3. An apparatus according to claim 1, in which the shaping die has a flow axis substantially in line with the axes of the extrusion passage and of said wider space.

4. An apparatus according to claim 1, in which the shaping die has more than one flow passage for the metal, said passages having outer walls substantially in line with part of the outer wall of said wider space.

5. An apparatus according to claim 1, in which the extrusion passage merges into the wider space via a substantially conical or pyramidal wall part having a total cone angle of from 75° to 105°.

* * * * *